US006938646B2

(12) United States Patent
Litton

(10) Patent No.: US 6,938,646 B2
(45) Date of Patent: Sep. 6, 2005

(54) NEEDLELOOM, WEAVING METHOD, AND TEXTILE ARTICLES FORMED THEREBY

(75) Inventor: Michael Gervase Litton, Prestwick (GB)

(73) Assignee: Vascutek Limited, Inchinnan (GB)

( * ) Notice: Subject to any disclaimer, the term of this patent is extended or adjusted under 35 U.S.C. 154(b) by 166 days.

(21) Appl. No.: 10/381,529

(22) PCT Filed: Sep. 28, 2001

(86) PCT No.: PCT/GB01/04320

§ 371 (c)(1),
(2), (4) Date: Mar. 26, 2003

(87) PCT Pub. No.: WO02/27085

PCT Pub. Date: Apr. 4, 2002

(65) Prior Publication Data

US 2005/0072485 A1 Apr. 7, 2005

(30) Foreign Application Priority Data

Sep. 28, 2000 (GB) ..... 0023734
Nov. 15, 2000 (GB) ..... 0027862

(51) Int. Cl.[7] ..... D03D 41/00

(52) U.S. Cl. ..... 139/11; 139/20; 139/387 R; 623/1.51

(58) Field of Search ..... 623/1.51; 139/11, 139/440, 441, 442

(56) References Cited

U.S. PATENT DOCUMENTS 2,241,202 A * 5/1941 Jameson ..... 139/440
4,668,545 A * 5/1987 Lowe ..... 428/35.1
5,035,267 A * 7/1991 Shimono ..... 139/116.1

FOREIGN PATENT DOCUMENTS

EP 0516027 12/1992 ..... D03D/3/02
GB 2247696 A 8/1991 ..... A61F/2/06
GB 2309038 4/1996 ..... D03D/3/00

* cited by examiner

*Primary Examiner*—John J. Calvert
*Assistant Examiner*—Andrew W. Sutton
(74) *Attorney, Agent, or Firm*—Drinker Biddle & Reath LLP

(57) ABSTRACT

A method of weaving tubular textile articles, comprising: forming first, second, third and fourth superposed layers of warp threads; weaving by weft insertion through sheds formed in said layers, the weaving being performed by first and second weft threads inserted by first and second needles from one side of said warp layers; each weft thread being inserted alternately through a selected pair of said warp layers; and the weft loops at the other side of said layers being knitted together, the first layer with the second layer and the third layer with the fourth layer, to form a pair of selvedges. A tubular textile article formed by the method is provided. A needleloom for weaving such articles is also provided.

11 Claims, 7 Drawing Sheets

20
22
30
24
32
26
14
34
36
28
16

30
32

30
32

30
32
30
32

NEEDLELOOM, WEAVING METHOD, AND TEXTILE ARTICLES FORMED THEREBY

The present invention concerns a needleloom able to produce tubular textile articles; in particular tubular bifurcated grafts for medical use. Also provided are a method of weaving and the tubular textile articles produced thereby.

Bifurcated woven grafts are used for bypass of the aorta and iliac arteries. These grafts have traditionally been woven on a shuttle loom using two or more shuttles for each weaving head. A shuttle loom relies upon the shuttle (yarn-package carrier) being passed through the shed (i.e. the opening formed by separating warp threads during the operation of weaving) to insert the weft yarn. The shuttle will carry sufficient weft for many picks. Shuttle loom weaving suffers from several problems, but by far the most important drawback is that of poor yield. An overall yield as low as 10% is not uncommon with shuttle weaving, with even worse figures for larger sized pieces. This problem is compounded by the fact that shuttle looms are intrinsically slow manufacturing machines. The disadvantages of the shuttle loom are mainly due to the fact that a large shed is required for the through passage of the boat shuttle through the warps. In other words, warp threads need to be separated by a relatively large angle to create sufficient distance between the threads to allow passage of the shuttle. This leads to a high peak tension in the warp threads, which in turn causes dirt to be transferred to the warp ends from the needle wires. A large shed also leads to greater warp end breakage and yarn filamentation. There has never been any satisfactory solution to the difficulties.

For almost all textiles, alternatives such as needleloom weaving, knitting or felting have largely replaced shuttle loom weaving. However, since neither knitting nor felting can provide grafts of sufficient density and consistent quality, and since technical difficulties have so far precluded the use of needleloom weaving, shuttle loom weaving is the only methodology used to date to produce woven bifurcated tubular medical grafts.

A needleloom is a shuttleless loom in which the weft yarn is drawn from a stationary supply and introduced into the shed by a weft yarn insertion needle with the weft yarn disposed in the form of a double pick (i.e. the weft yarn is doubled back from the leading end of the weft yarn insertion needle). The weft is retained at the opposite selvedge by the action of knitting, or by the introduction of a locking thread from a separate supply. Whilst simple (unbifurcated) tubular medical grafts can be produced using needleloom technology, technical difficulties have prevented this approach being used successfully for bifurcated tubular grafts.

The present invention provides apparatus and methodology able to overcome those technical difficulties.

The present invention provides a method of weaving tubular textile articles, comprising:

- forming first, second, third and fourth superposed layers of warp threads;
- weaving by weft insertion through sheds formed in said layers, the weaving being performed by first and second weft threads inserted by first and second needles from one side of said warp layers;
- each weft thread being inserted alternately through a selected pair of said warp layers; and
- the weft loops at the other side of said layers being knitted together, the first layer with the second layer and the third layer with the fourth layer, to form a pair of selvedges.

In a first mode of operation, the first weft thread is inserted alternately through the first and second warp layers, and the second weft thread is inserted alternately through the third and fourth warp layers, to form two superposed tubes.

In a second mode of operation, the first weft thread is inserted alternately through the first and fourth warp layers, and the second weft thread is inserted alternately through the second and third warp layers, to form a single tube folded in a C-shape.

The invention further provides a method of weaving a bifurcated tubular textile article, comprising weaving a pair of tubes by the first of the above modes of operation, followed or preceded by weaving a single tube by the second of the above modes of operation using the same warp and weft threads.

The weft loops may be knitted through each other, or knitted together with a binder thread.

Preferably, the tubular article is a surgical or veterinary graft, most preferably being bifurcated and forming an aortic or iliac graft.

From another aspect, the present invention resides in a needleloom for weaving tubular textile articles, comprising: warp yarn disposal means for disposing warp yarns in superposed first, second, third and fourth warp yarn layers;

- shed-forming means for forming a shed in each of said warp layers;
- first and second weft insertion needles for inserting first and second weft threads from one side of said warp layers;
- upper and lower selvedge knitting means at the other side of the warp layers for knitting together weft loops formed at the first and second warp layers and the third and fourth warp layers, respectively; and
- control means operable to cause the needleloom to operate selectively in one of two modes, a first mode passing the first weft thread alternately through the first and second warp layers and the second weft thread alternately through the third and fourth warp layers thereby to form two superposed tubes, and a second mode passing the first weft thread alternately through the first and fourth warp layers and the second weft thread alternately through the second and third warp layers thereby to form a single tube folded in a C-shape.

In a preferred form, the first and second weft insertion needles are located one above the other with a similar spacing to the spacing between the warp layers, and the control means is operable to cause relative vertical movement between the weft insertion needles and the warp layers.

In one preferred form, the first weft insertion needle is alternately aligned with the first and second warp layers, the second weft insertion needle is alternately aligned with the third and fourth warp layers, and when operating in said second mode the weft threads are interchanged between the first and second weft insertion needles in synchronism with said relative movement.

Preferably also, the first weft thread passes through a first weft selector and the second weft thread passes through a second weft selector which is located closer to the warp layers than said first weft selector.

It is to be noted that looms are commonly operated such that the weft yarns form a layer which is substantially horizontal in a direction transverse to the longitudinal extent of the warp yarns such that there is an inherent "up" and "down" (as defined by natural gravity) and consequently two or more superimposed layers of warp yarns automatically have an "upper" and a "lower" in respect of their relative dispositions. However, since operation of the needleloom in accordance with the invention is independent of gravity, the use of the terms "upper" and "lower" are arbitrary.

The needleloom of the present invention is especially suitable for production of medical and veterinary grafts, and in particular for vascular grafts. The needleloom may be used for weaving a bifurcated tubular graft. However, the needleloom of the present invention is not limited to weaving bifurcated tubular grafts alone; by remaining in the second mode of needleloom operation the needleloom also permits weaving of tapered tubular grafts, in particular where the tapers slope bilaterally symmetrically from both lateral edges of the tubular graft. Further, by remaining in the first mode of needleloom operation, the needleloom simultaneously weaves two relatively narrow tubular grafts, thus doubling output in comparison to the weaving of a single relatively narrow tubular graft.

Desirably the method described above uses a Muller System II selvedge (where the weft is interlaced with a binder thread) or a Muller System III selvedge (where the weft yarn and binder thread are interlaced together in one go). Muller System II selvedges produce a thinner edge and are less bulky, whereas the Muller System III selvedge, although thicker, is more run proof.

Embodiments of the present invention will now be described by way of example with reference to the accompanying drawings wherein:

FIGS. 1*a* and 1*b* are cross-sections respectively of the legs and of the body of a bifurcated tubular graft, the cross-sections being transverse to the weaving direction which is into the plane of the drawing;

FIGS. 6*a*–6*f* depict successive stages in the needleloom weaving of the legs of the vascular graft; and FIGS. 7*a*–7*g* depict successive stages in the needleloom weaving of the body of the vascular graft.

Figure 8A:
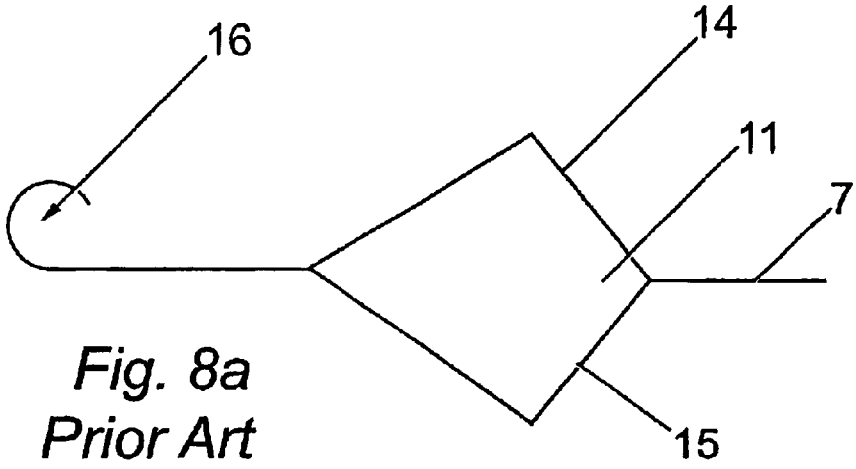
Fig. 8a Prior Art
Figure 8B:
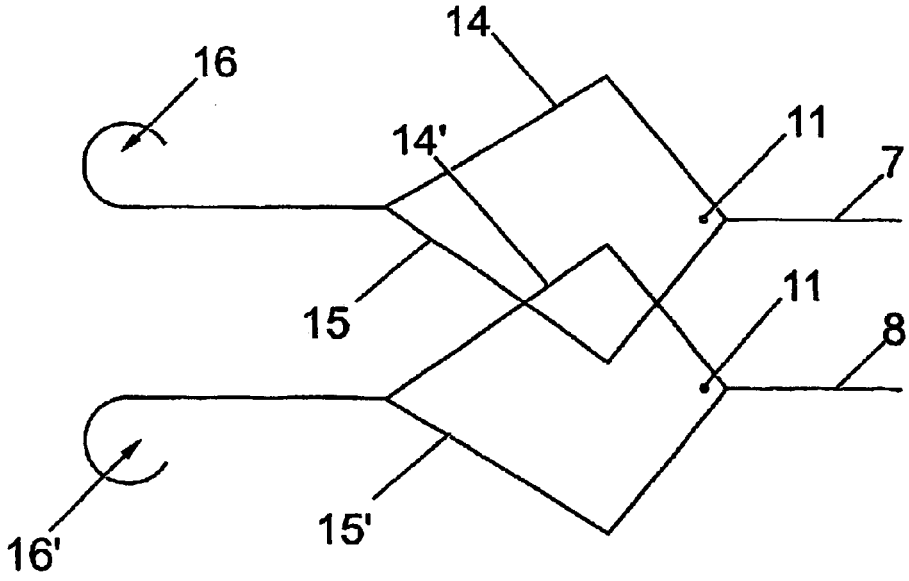

FIG. 8*a* shows a conventional design of shed for a needleloom. FIG. 8*b* shows a modified design of shed enabling operation of the twin needleloom of the present invention to manufacture a single body in the form of a four-layered graft.

It should be noted that, in cross-section, the grafts would be held flat by plates but, for clarity of illustration, the grafts are shown-so that each thickness of cloth can be determined.

Figure 1A:
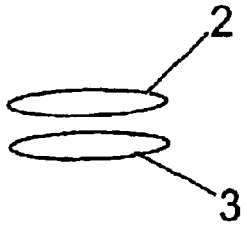
Figure 1B:
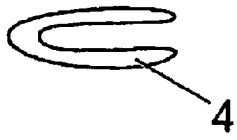

Referring first to FIGS. 1*a* and 1*b*, a bifurcated tubular graft is woven folded over such that one leg 2 weaves flat on top of the other leg 3 (FIG. 1*a*) and the body 4 is folded along its middle (FIG. 1*b*) to form a four-layered graft. Weaving of the legs 2, 3 according to FIG. 1*a* is straightforward and can also be achieved with standard weaving techniques but weaving of the body 4 presents many problems.

The solution of the present invention is to weave the body 4 with two weft yarns 5, 6 (FIG. 2) where one weft yarn 5 alternately weaves the top layer 7 and the bottom layer 8 of the four-layered graft whilst the second weft 6 alternately weaves the two centre layers 10, 9. This requires that the two weft yarns 5, 6 can interchange with one another. In known methodology, three weft yarns would be required, a first weft yarn for the body, a second weft yarns for one leg of the biforcate graft and a third weft yarn for the other leg of the biforcate graft, although these weft yarns would not interchange in the manner envisaged in the present invention.

Figure 3:
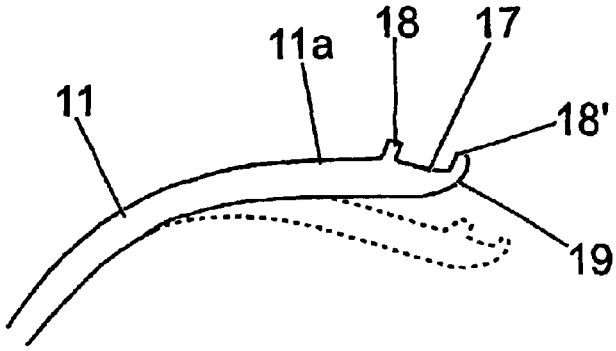
FIG. 3 illustrates a needle suitable to interchange the weft yarns at or very near the stop point for the weft needles.

Two forked weft needles to catch the changed wefts on entry were tried but the shedding did not permit such a broad front to the weft needle. Two weft yarn insertion needles were therefore tried, each in the form of a needle 11 as shown in FIG. 3 and arranged to interchange the wefts 5, 6 at or very near the stop point for the weft yarn insertion needles when out of the shed. This requires the top weft yarn insertion needle to accept a weft from underneath rather than from above which is normal practice. This is described further with reference to FIGS. 7*a* and 7*g*. The important features of the weft yarn insertion needle 11, which are provided by modification of commercially available weft yarns insertion needles, consist of the free end 19 of the needle 11 with a dovetail notch 17 shaped and dimensioned to carry a weft yarn (not shown in FIG. 3) during shed-penetrating movements.

The diameter and length of thee weft yarn insertion needle 11 are standard, and are dictated to conform with the weaving loom itself. The modification of the weft yarn insertion needle 11 so that it is suitable for use in the present invention concerns the radius of the curvature of the needle 11 and the depth and spacing of the teeth 18, 18' forming the notch 17. Essentially the radius of curvature is increased so that the needle is less bent relative to a conventional needle. Essentially, the shape of the weft yarn insertion needle is changed to bring the free end 19 and notch 17 as close as possible but without touching the weft selectors at the end of each weft insertion cycle.

An appropriate shape for a conventional needle is shown in dotted outline in FIG. 3 for comparison. Additionally, the spacing between teeth 18, 18' is increased relative to that of a conventional needle to facilitate the exchange of weft and the depth of notch 17 is increased to ensure that the wefts remain securely within the notch 17.

Figure 4:
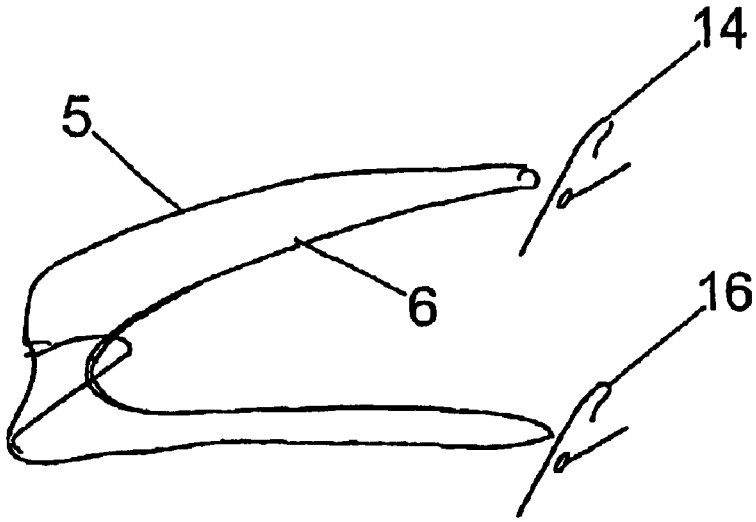
FIG. 4 illustrates how the weft yarns might catch with one another without proper arrangement.

There is the real possibility that the wefts 5, 6 for the body 4 will catch with one another at the entry point to the warps making a cross-section as depicted in FIG. 4 The solution in this embodiment of the invention is to ensure that the weft yarn 6, which is weaving the inner layers of the body 4, is always in the weft selector nearer to the cloth being woven.

Weft yarn 5 which weaves the top and bottom layers 7, 8 requires less weft yarn when weaving bodies compared with the yarn requirement when weaving legs and the second weft yarn 6 correspondingly requires more yarn. A semi-positive weft feed (as opposed to a positive weft feed) accommodates these varying requirements.

Figure 2:
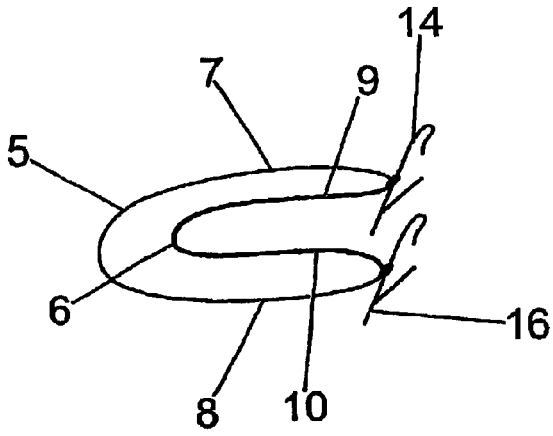
FIG. 2 illustrates the interchange between the two weft yarns used in weaving the body of FIG. 1*b;*
Figure 5:
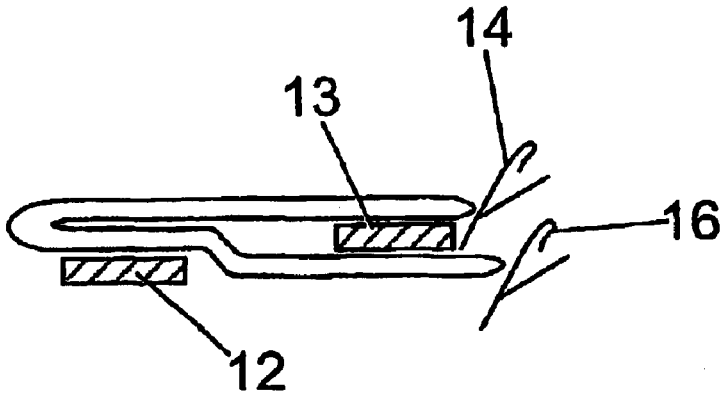
FIG. 5 illustrates two plates used to separate the woven article by an amount equal to the needle spacing.

When weaving on a twin needle loom of this embodiment of the invention it is necessary for mechanical reasons for there to be a vertical gap of at least five millimetres between the selvedge knitting needles 14 and 16 (FIGS. 2, 4, and 5) and a similar gap between the weft insertion needles (not shown in FIGS. 2, 4 and 5). Such a gap would cause there to be a threadbare section at the entry point of the tube (ie. where the weft insertion needles enter), particularly when weaving graft bodies. A first plate 12 (FIG. 5) largely solves this problem by closing the entry gap to a minimum. To ensure that in the worst case where graft bodies are woven there is no threadbare section, it is necessary to redesign the drafting of the warps as shown in Appendix 1.

Normally, when weaving on a twin needle loom, the upper two layers are formed by the upper weft and constantly pull upwards and the lower two with the lower weft pull downwards during shedding to keep the vertical positions of the cloth fells constant. This is the case when weaving legs and is important for consistent weaving. However, for weaving of the body, the weft yarns regularly interchange their positions and to keep the cloth fells at constant heights a second plate 13 is inserted (FIG. 5).

With the two plates 12 and 13 in position the shed and heddle wires are modified to allow a clean passage of the weft yarns. FIG. 8*a* shows in schematic form a conventional needle loom shed design whereas FIG. 8*b* shows a modification suitable to enable operation of the present invention in the formation of a body and/or simultaneous weaving of the legs. In FIGS. 8*a* and 8*b*, the shed is the gap described by the upper warps 14 and lower warps 15. In the modified shed design of FIG. 8*b* each weft has both upper and lower warps, the warps having separate beams 16 and 16'. The woven cloth is formed as 2 separate layers 7, 8. The positioning of the weft insertion needle 11 at the fall of the cloth is indicated for clarity. It should be noted that the length of the top warp yarn 14, 14' of the shed must be equal to the length of the bottom warp yarn 15, 15' of the same shed, but there is no requirement in the modified design of FIG. 8*b* for both warp yarns 14, 14' to be of equal lengths.

Details of the needleloom weaving of the graft legs 2 and 3 (FIG. 1*a*) will now be discussed with reference to FIGS. 6*a*–6*f*, and details of the needleloom weaving of the graft body 4 (FIG. 1*b*) will thereafter be described with reference to FIGS. 7*a*–7*g*.

The needleloom whose operation is essentially a Muller Needleloom modified in various respects about to be detailed, including the disposition of the warp yarns in four layers and the provision for transposing two weft yarns between two weft yarn insertion needles at selected instances in the cycle of needleloom movements. For the sake of clarity, only those parts of the needleloom essential for explaining the weaving method of the invention are illustrated in FIGS. 6*a*–7*g*, and the greater part of the needleloom is omitted from the drawings.

Each of FIGS. 6*a*–7*g* is a cross-section of the warp yarns transverse to the direction in which the tubular article is being woven, which is vertically down into the plane of the drawings. For the purposes of this description of this invention, "up" is towards the top of any individual Figure, and "down" is towards the bottom of any individual Figure, with the relative terms "upper" and "lower" being construed accordingly. Correspondingly, use of the terms "left" and "right" accord with the same directions in the individual Figures.

At each of the successive stages depicted in FIGS. 6*a*–7*g*, the warp yarns are divided into four mutually distinct layers which are superimposed into a stack of warp yarn layers, each of these four layers being vertically subdivided in turn into two sub-layers which together form a shed for that layer. (Although each of these sub-layers is a row of warp yarns viewed in transverse cross-section and should strictly be depicted as a row of dots or small circles, for simplicity each sub-layer of warp yarns is depicted as a single continuous horizontal line). At appropriate instants in the cycles of needleloom movements about to be detailed, the two sub-layers of each layer of warp yarns have their respective positions mutually interchanged so as properly to interleave the respective weft yarn through the warp yarns at that layer. (Needleloom components for disposing the warp yarns in four layers, and for forming sheds in each of these layers, are not shown in the drawings). It is to be noted that although the two sub-layers in each warp yarn layer regularly mutually interchange their respective positions, the layers as a whole do not change their relative positions within the stack.

Figure 6A:
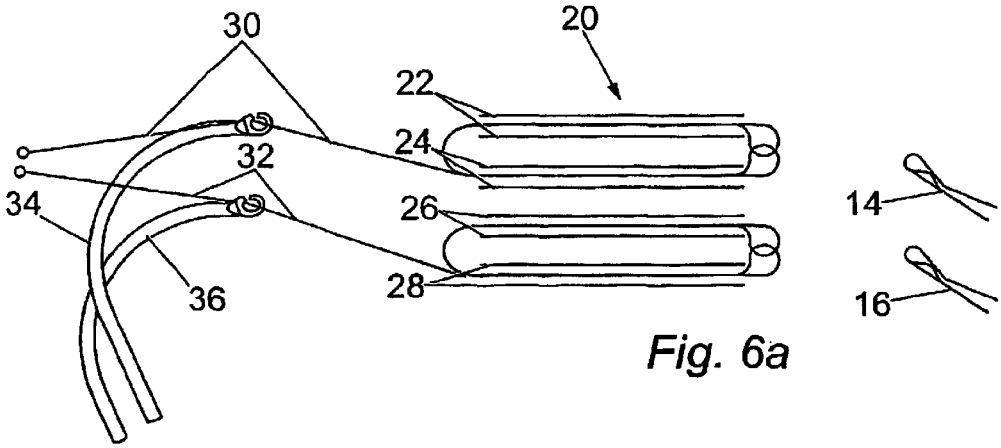

Referring to FIG. 6*a* in particular, the warp yarns are disposed in a stack 20 of four mutually distinct and equidistantly superimposed layers, namely an upper outside layer 22, an upper inside layer 24, a lower inside layer 26, and a lower outside layer 28. Each of these four layers is sub-divided by the shed-forming means (not shown) into a respective pair of sub-layers whose vertical positions with respect to the other sub-layer within each pair of sub-layers are mutually interchanged by the shed-forming means at appropriate moments in the cycle of needleloom movements to allow the interweaving of a first weft yarn 30 or a second weft yarn 32 at appropriate stages in the weaving cycle, as will be detailed below.

To the left of the stack 20 are a pair of movably mounted weft insertion needles, namely an upper needle 34 and a lower needle 36.

The needles 34 and 36 each engage with the first and second weft yarns 30 and 32 respectively to insert the respective weft yarn into the shed formed between the sub-layers of a selected one of the four warp yarn layers 22, 24, 26 and 28 (as detailed below). The needles 34 and 36 are mutually mechanically linked so as to move conjointly in a lateral direction. When the needleloom is operating in its first mode of operation to weave the graft legs 2 and 3 (as detailed in FIGS. 6*a*–6*f*), the first weft yarn 30 remains continuously engaged with the upper weft insertion needle 34 and the second weft yarn 32 remains continuously engaged with the lower weft insertion needle 36. However, when the needleloom is operating in its second mode of operation to weave the graft body 4 (as detailed in FIGS. 7*a*–7*g*), the first weft yarn 30 is, at various parts of the weaving cycle, either engaged with the upper weft insertion needle 34 (FIGS. 7*a*, 7*b*, 7*c* and 7*g*) or engaged with the lower weft insertion needle 36 (FIGS. 7*d*, 7*e* and 7*f*) while the second weft yarn 32 is contemporaneously carried by the one of the weft insertion needles 34 and 36 not currently carrying the first weft yarn 30. (Means for interchanging the first and second weft yarns 30 and 32 between the upper and lower weft insertion needles 34 and 36 are not shown in the drawings). To the right of the stack 20 are the pair of selvedge knitting needles previously described with reference to FIGS. 2, 4 and 5, namely the upper selvedge knitting needle 14 and the lower selvedge knitting needle 16. During both modes of needleloom operation, the upper selvedge knitting needle 14 is operated when one or other of the weft yarns 30 and 32 is passed by the upper weft insertion needle 34 through the respective shed in one or other of the two upper warp layers 22 and 24 to knit together the adjacent selvedges at the right edge of the two upper weft layers 22 and 24. Also during both modes of needleloom operation, the lower selvedge knitting needle 16 is operated when one or other of the weft yarns 30 and 32 is passed by the lower weft insertion needle 36 through the respective shed in one or other of the two lower warp layers 26 and 28 to join together the adjacent selvedges at the right edge of the two lower warp layers 26 and 28.

At all times, the selvedge knitting needles 14 and 16 remain at the same height with respect to the warp layer stack 20.

While FIG. 6*a* contains reference numerals for all components and materials, these reference numerals will be left out of FIGS. 6*b*–7*g* for increased clarity, except where one or more reference numerals are considered to be necessary or convenient for understanding of particular Figure.

Reverting to FIG. 6*a*, this shows the weft yarn insertion needles 34 and 36 laterally retracted leftwards away from the warp yarn layer stack 20, with the upper needle 34 trailing the first weft yarn 30 from the shed between the two sub-layers of the upper inside layer 24, and with the lower needle 36 trailing the second weft yarn 32 from the shed between the two sub-layers of the lower outside layer 28. (See the subsequent description of FIG. 6*f* for an explanation of how the arrangement of FIG. 6*a* is arrived at). FIG. 6*a* also shows the selvedge knitting needles 14 and 16 laterally retracted rightwards away from the warp yarn layer stack 20, with the upper selvedge knitting needle 14 having immediately previously knitted a selvedge uniting the adjacent right edges of the two upper layers 22 and 24, and with the lower selvedge knitting needle 16 having immediately previously knitted a selvedge uniting the adjacent right edges of the two lower layers 26 and 28. Following the weaving of layers 24 and 28 the yarn layer stack realigns to weave layers 22 and 26.

Figure 6B:
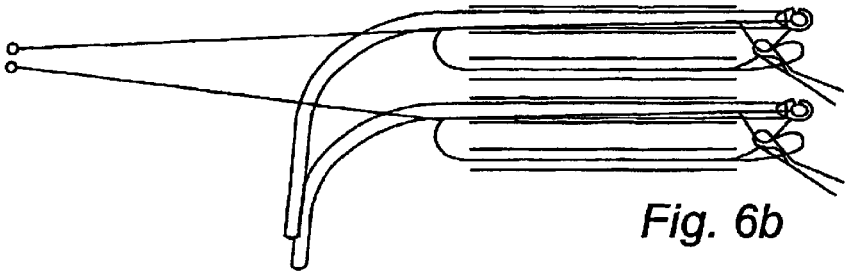

Referring now to FIG. 6*b*, this illustrates the stage in first-mode needleloom operation immediately following the previously completed stage described above with reference to FIG. 6*a*. As shown in FIG. 6*b*, both weft yarn insertion needles 34 and 36 have been moved fully rightwards to cause the upper needle 34 to penetrate the shed formed between the two sub-layers of the upper outside warp yarn 22, and to cause the lower needle 36 to penetrate the shed formed between the two sub-layers of the lower inside warp yarn layer 26. The upper needle 34 thereby carries the first weft yarn 30 rightwards through the shed of the upper outside layer 22 to the right side of layer 22 where the weft yarn 30 is knitted by the upper selvedge knitting needle 14 with the right edge of the adjacent upper inside layer 24 to unite these two edges in a common selvedge. Also, the lower needle 36 carries the second weft yarn 32 rightwards through the shed of the lower inside layer 26 to the right side of the layer 26 where the weft yarn 32 is joined by the lower selvedge knitting needle 16 with the right edge of the adjacent lower outside layer 28 to unite these two edges in a common selvedge.

Figure 6C:
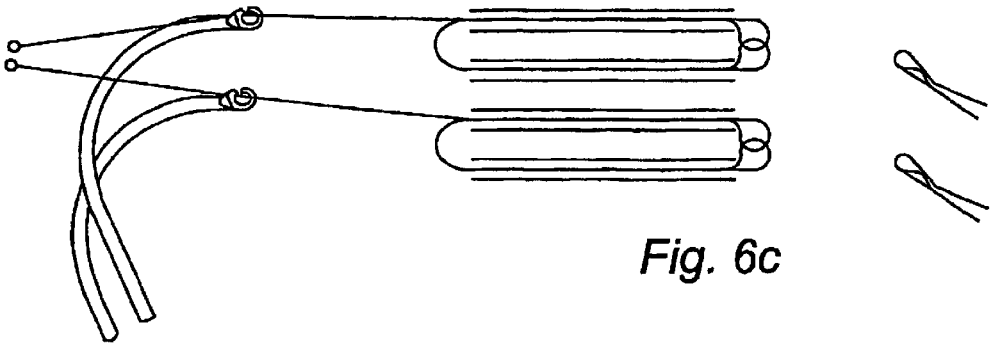

Following the weaving and selvedge knitting stage of FIG. 6*b*, the weft insertion needles 34 and 36 are fully withdrawn leftwards out of the layers 22 and 26 as shown in FIG. 6*c*, leaving the first weft yarn 30 woven into the upper outside layer 22 and leaving the second weft yarn 32 woven into the lower inside layer 26. At the same time, the selvedge knitting needles 14 and 16 are fully withdrawn rightwards to be clear of the newly knitted selvedges.

Figure 6D:
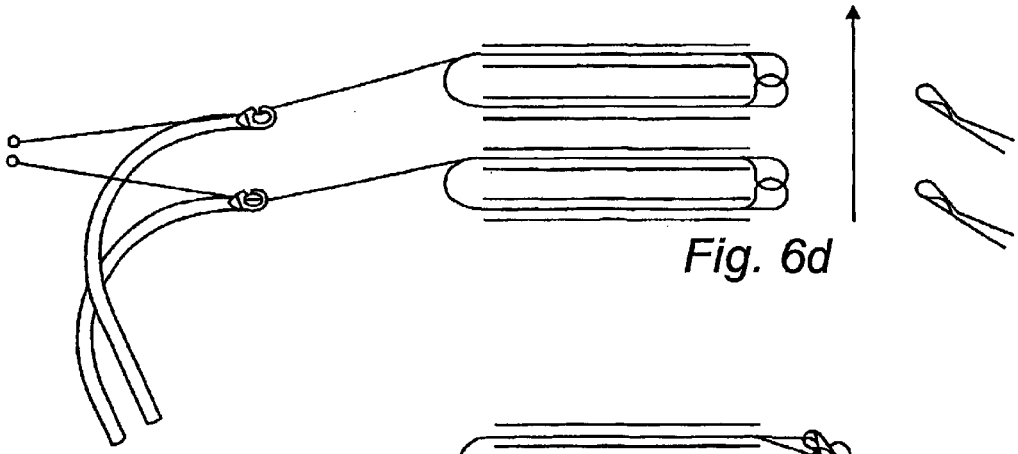

Turning now to FIG. 6*d*, this shows the stack 20 moved bodily upwards. This stack movement brings the upper inside layer 24 level with the upper weft insertion needle 34, and brings the lower outside layer 28 level with the lower weft insertion needle 36, so creating the alignments necessary for the next stage in the first mode of needleloom operation. Requisite movement of the stack can be accomplished by any suitable procedure.

Figure 6E:
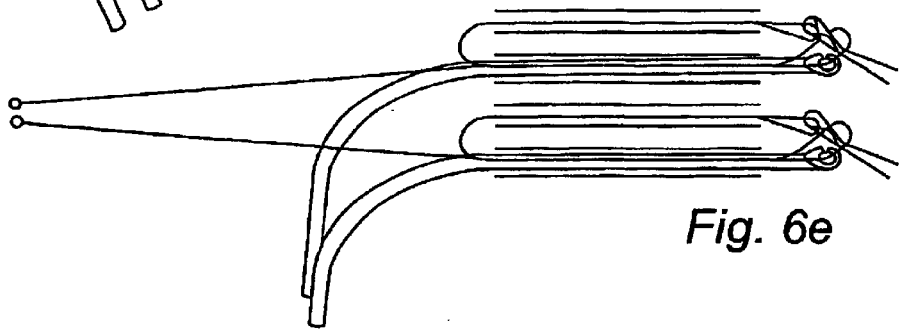

FIG. 6*e* shows the next stage in the first mode of needleloom operation, wherein both weft yarn insertion needles 34 and 36 have been moved fully rightwards to cause the upper needle 34 to penetrate the shed formed between the two sub-layers of the upper inside layer 24, and to cause the lower needle 36 to penetrate the shed formed between the two sub-layers of the lower outside warp yarn layer 28. The upper needle 34 thereby carries the first weft yarn 30 rightwards through the shed of the upper inside layer 24 to the right side of the layer 24 where the weft yarn 30 is knitted by the upper selvedge knitting needle 14 with the right edge of the adjacent upper outside layer 22 to unite these two edges in a common selvedge. Also, the lower needle 36 thereby carries the second weft yarn 32 rightwards through the shed of the lower outside layer 28 to the right side of the layer 28 where the weft yarn 32 is knitted by the lower selvedge knitting needle 16 with the right edge of the adjacent lower inside layer 26 to unite these two edges in a common selvedge.

Figure 6F:
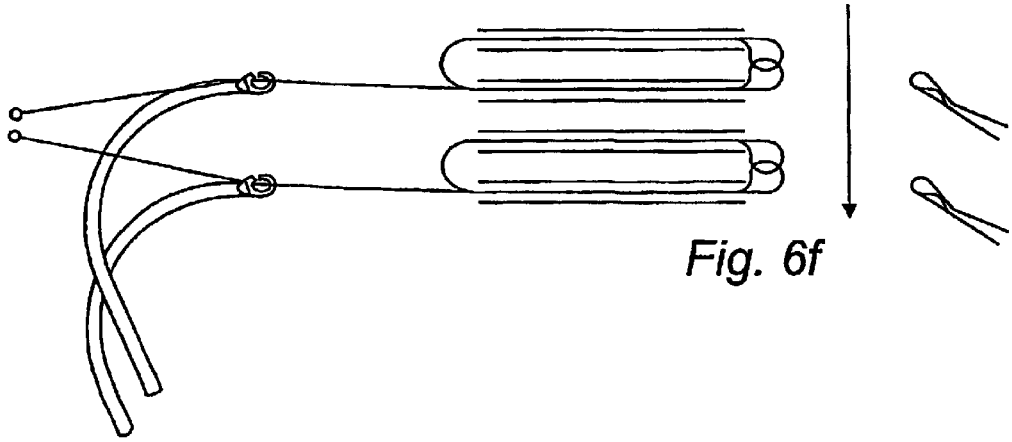

Following the weaving end selvedge knitting stage of FIG. 6*e*, the weft insertion needles 34 and 36 are fully withdrawn leftwards out of the layers 24 and 28 as shown in FIG. 6*f*, leaving the first weft yarn 30 woven into the upper inside layer 24 and leaving the second weft yarn 32 woven into the lower outside layer 28. At the same time, the selvedge knitting needles 14 and 16 are fully withdrawn rightwards to be clear of the newly knitted selvedges.

Following the stage illustrated in FIG. 6*f*, the stack 20 is moved bodily downwards. This exactly reverses the upward movement of the stack 20 described with reference to FIG. 6*d*, and produces the arrangement shown in FIG. 6*a*, so completing a full cycle of needleloom movements in the first mode of needleloom operation.

It is to be noted that beating-up (i.e. forcing the picks of newly woven weft yarn into the fells) will take place at suitable points in the above-described sequence of stages (e.g. at the stage shown in FIG. 6*c* and/or at the stage shown in FIG. 6*f*). Any suitable means for beating-up may be employed, but such means are omitted from the drawings.

The cycle of operations described above with reference to FIGS. 6*a*–6*f* is repeated an appropriate number of times, with appropriate feeding of the weft yarns 30 and 32, and winding on from the needle insertion regions of the twin tubes (2 and 3, FIG. 1*a*) woven by this first mode of needleloom operation. When a predetermined length of the twin tubes has been woven, the needleloom is switched to a second mode of needleloom operation which will now be described with reference to FIGS. 7*a*–7*g*.

The second mode of needleloom operation results in the weaving of a single tube which serves as the body 4 (FIG. 1*b*) of the graft. The transitions from twin tube to single tube, and the alternate transitions from single tube to twin tube, each form a respective crotch in the woven textile article produced by operation of the needleloom, each crotch being the Y-junction in the resultant grafts when cut to length from the normally continuous alternating single/twin tubing woven by the needleloom.

Figures 7A, 7B, 7C, 7D:
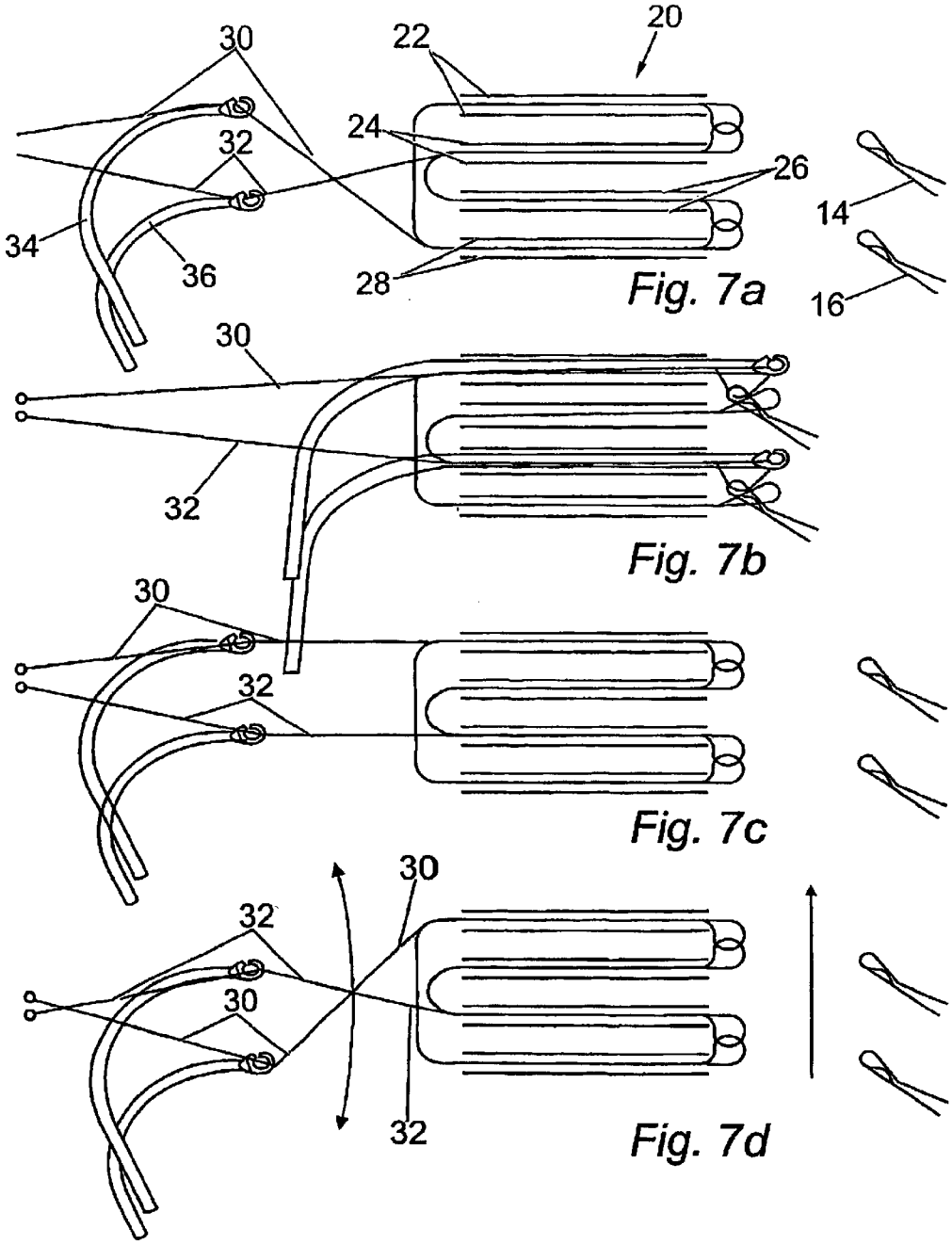

FIG. 7*a* shows the weft yarn inserting needles 34 and 36 laterally retracted leftwards away from the warp yarn layer stack 20, with upper needle 34 trailing the first weft yarn 30 from the shed between the two sub-layers of the lower outside layer 28, and with the lower needle 36 trailing the second weft yarn 32 from the shed between the two sub-layers of the upper inside layer 24. (See the subsequent description of FIG. 7*g* for an explanation of how the arrangement of FIG. 7*a* is arrived at). FIG. 7*a* also shows the selvedge knitting needles 14 and 16 laterally retracted rightwards away from the warp yarn layer stack 20, with the upper selvedge knitting needle 14 having immediately previously knitted a selvedge uniting the adjacent right edges of the two upper layers 22 and 24, and with the lower selvedge knitting needle 16 having immediately previously knitted a selvedge uniting the adjacent right edges of the two lower layers 26 and 28.

The arrangement of FIG. 7*a* corresponds to the arrangement of FIG. 6*a* except that whereas in the first mode of needleloom operation (FIGS. 6*a*–6*f*), the first weft yarn 30 was woven alternately into the two upper layers 22 and 24 while the second weft yarn 32 was woven alternately into the two lower layers 26 and 28, in the second mode of needleloom operation (FIGS. 7*a*–7*g*), the first weft yarn 30 is woven alternately into the two outside layers 22 and 28 while the second weft yarn 32 is woven alternately into the two inside layers 24 and 26. (In the second mode of needleloom operation, respective selvedges continue to mutually unite the two upper layers 22 and 24 and to mutually unite the two lower layers 26 and 28, in the same manner as in the first mode of needleloom operation).

Referring now to FIGS. 7*b* and 7*c*, these stages of the second mode of needleloom operation (which follow in succession from the stages shown in FIG. 7*a*) correspond to the equivalent stages of the first mode of needleloom operation as shown in FIGS. 6*b* and 6*c*, save for the different starting configuration shown in FIG. 7*a* (compare with FIG. 6*a*).

The next stage of the second mode of needleloom operation as shown in FIG. 7*d* demonstrates one of the most significant differences in the second mode with respect to the first mode of needleloom operation, namely the transposition of the weft yarns 30 and 32 between the weft insertion needles 34 and 36 in readiness for the next stage of needleloom operation. Whereas the stages shown in FIGS. 7*a*, 7*b* and 7*c* had the first weft yarn 30 carried by the upper weft yarn insertion needle 34 and the second weft yarn 32 carried by the lower weft yarn insertion needle 36 (i.e. as done throughout the first mode of needleloom operation and illustrated in FIGS. 6*a*–6*f*), the subsequent stages shown in FIGS. 7*d*, 7*e* and 7*f* require the first weft yarn 30 to be carried by the lower weft yarn insertion needle 36 and the second weft yarn 32 to be carried by the upper weft yarn insertion needle 34. Weft yarn changeover takes place at the stage shown in 7*d*, with the interchange being conducted by weft selectors (not shown), the weft selector for the second weft yarn 32 being located laterally closer to the stack 20 than the weft selector for the first weft yarn 30 so as to avoid the unwanted weft yarn entanglement previously mentioned with-reference to FIG. 4. The weft selection may each consist of a heddle wire arrangement for each weft yarn, with the weft yarn passing through an eye in the weft selector. The weft selectors are independently moveable in a direction traverse to that of weft insertion. Hence the weft selector carrying the yarn to be inserted into the upper weft yarn insertion needle 34 moves upwardly (as viewed in FIG. 7) at the moment the upper weft yarn insertion needle 34 is fully retracted and prior to its next insertion in the cycle. The upward movement of the weft selector lifts the yarn out of the lower weft yarn insertion needle 36, and over the upper weft yarn insertion needle 34 such that the yarn drops into the notch 17 of needle 34 as that needle commences its next insertion cycle. Simultaneously the weft selector carrying the yarn to be inserted into the lower weft yarn insertion needle 36 moves that yarn downwardly to facilitate its accurate placement into notch 17 of the lower weft yarn insertion needle 36. In the second mode of needleloom operation, this weft selector is initially located at a position such as to just lift the weft out of the upper weft yarn insertion needle at the end of the insertion cycle. At the same time as the weft yarn positions are interchanged, the stack 20 is bodily moved upwards.

Figure 7E:
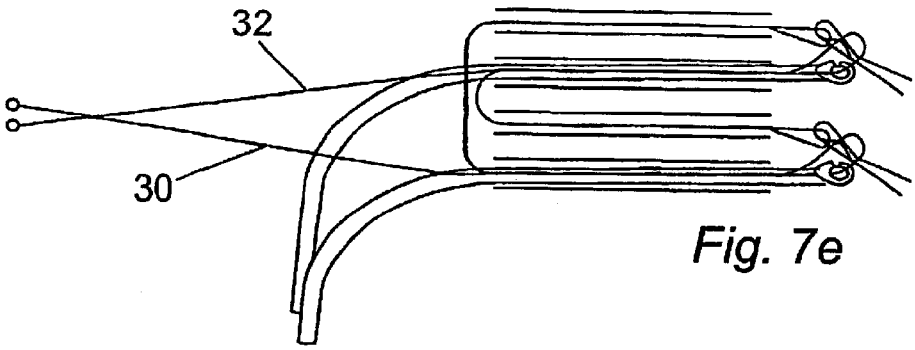
Figure 7F:
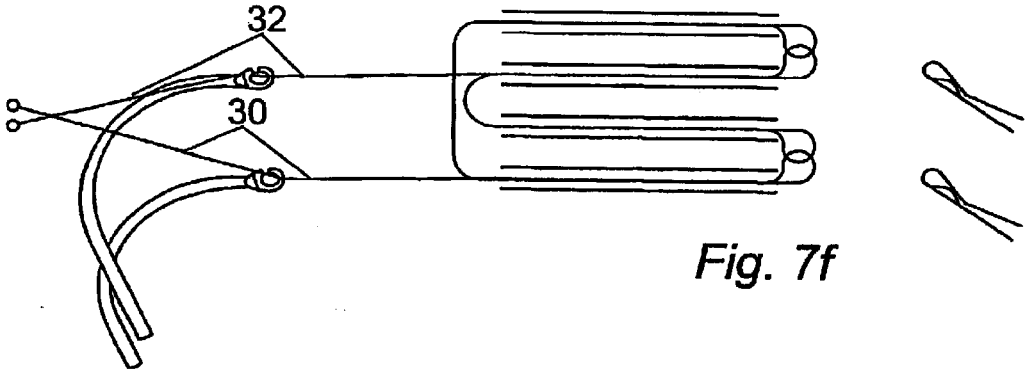

Following the weft yarn interchange shown in FIG. 7*d*, the next stage of the second mode of needleloom operation is shown in FIG. 7*e* which corresponds to the first-mode stage shown in FIG. 6*e* except that in FIG. 7*e*, it is the second weft yarn 32 that is woven into the upper inside layer 24 and the first weft yarn 30 that is woven into the lower outside layer 28. (Selvedge knitting continues as before). At the conclusion of FIG. 7*e* stage, all the various needles are laterally retracted as shown in FIG. 7*f* (which corresponds to FIG. 6*f*).

Figure 7G:
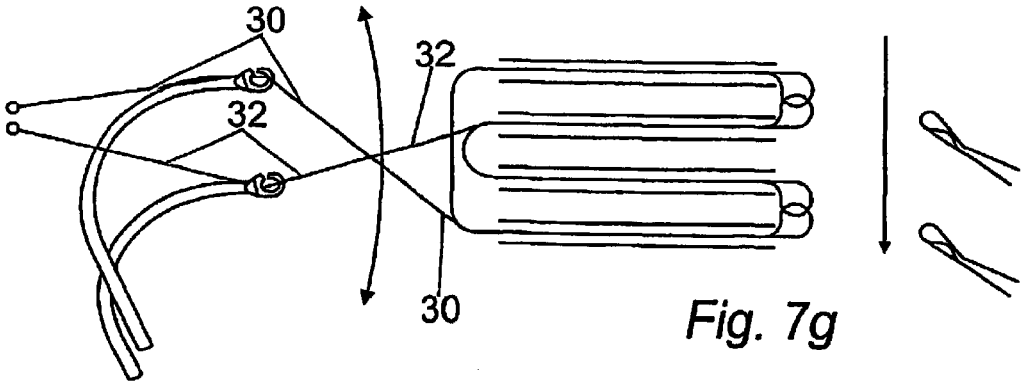

The final stage of the second mode of needleloom operation is illustrated in FIG. 7*g*, wherein the weft yarns 30 and 32 are again transposed between the weft yarn insertion needles 34 and 36, such that the first weft yarn 30 is returned to the upper needle 34 and the second weft yarn 32 is returned to the lower needle 36. As the same time, the stack 20 is bodily lowered to reverse the upward movement of FIG. 7*d*. These movements described with reference to FIG. 7*g* return the needleloom configuration to the starting configuration of FIG. 7*a*, and thereby complete the cycle of stages constituting the second mode of needleloom operation, i.e. the weaving of a single tube in a folded-double configuration (as previously detailed in FIG. 1*b*).

The cycle of operations described above with reference to FIGS. 7*a*–7*g* is repeated an appropriate number of times, with appropriate feeding of the weft yarns 30 and 32, and winding on from the needle insertion regions of the folded single tube (4, FIG. 1*b*) woven by this second mode of needleloom operation. When a predetermined length of the folded single tube has been woven, the needleloom is switched back to its first mode needleloom operation (as previously described with reference to FIGS. 6*a*–6*f*).

The drive/control arrangement which produces the alteration of the needles is standard equipment with commercially available twine needle looms. The changeover from the production of one tube to two legs and vice versa is easily controlled by programming the control unit of a commercially available twin needleloom.

Modifications and variations of the above-described needleloom and weaving method can be adopted without departing from the scope of the invention. For example, if the respective positions of the two weft yarn insertion needles 34 and 36 could be mutually interchanged during needleloom operation, then the second mode of needleloom operation (FIGS. 7*a*–7*g*) could be carried out by interchanging the needle positions at stages 7*d* and 7*g* without interchanging the weft yarns 30 and 32 between the needles 34 and 36.

EXAMPLE 1

Risk Assessment

Currently bifurcate grafts are produced on the Muller Shuttle Loom. These looms are relatively slow, can be unreliable and the grafts produced on them-can be prone to soiling. It is now intended to start producing bifurcate grafts on the Muller Needle Loom. This loom can offer a number of advantages:

(1) It takes less time to produce a bifurcate graft.

(2) It is more reliable, and if there is a problem during manufacture, the run can be aborted and a new graft manufactured immediately. This is unlike the shuttle loom, which must complete the faulty graft before starting a new graft.

(3) It produces graft with less soiling.

In addition to being produced on a different loom, the grafts from the needle loom will be produced with a Muller System II selvedge rather than the Muller System III selvedge that is used for other woven grafts. The Muller System II selvedge is thinner and less bulky than the Muller System III edge.

Muller System II Selvedge—Interlacing of the weft with a binder thread. This type of selvedge has a thinner edge and will be less bulky.

Muller System III Selvedge—Interlacing of the weft and binder thread in one go. This type of selvedge is thicker and run proof.

Testing was conducted to see whether:

(1) The grafts produced on the needle loom were as blood tight as those produced on the shuttle loom.

(2) The Muller System II selvedge causes blood leakage from the graft.

(3) The grafts produced on the needle loom have different physical characteristics than those manufactured on the shuttle loom.

(4) The Muller System II selvedge is weaker than the Muller System III selvedge.

Evaluation (1) Bench blood testing was carried out on grafts which have been produced on the Muller Needle Loom and then gel sealed. Particular attention was paid to the selvedge area, to ensure that the Muller System II edge is not having a negative effect. The testing conducted approximates to ISO7198, paragraph 8.2.3 except that anti-coagulated animal blood is used as the fluid. Briefly, the graph is attached to a reservoir of blood held at 120 mmHg by a regulated air supply. The blood is forced into the graft and any leakage is noted. Since the volume left is small, observation of leakage (rather than measurement of volume) is relied upon. The results are presented in Example 2.

(2) Physical testing was carried out on grafts produced from the needle loom. The testing was conducted in accordance with ISO7198 as detailed in Example 3. These results were compared with previous results for grafts produced on the shuttle loom. Again particular attention was paid to the selvedge area of the grafts with regard to the burst strength and water permeability. The results are presented in Example 3.

(3) The tensile strength of the selvedge was determined. This was carried out by cutting the graft into 2 cm sections; the graft was then cut longitudinally so that the selvedge was positioned in the middle of the fabric. The tensile strength was then tested as per ISO7198, paragraph 8.3.2. The results of the needle loom versus shuttle loom are presented in Example 3.

Results (1) The results of blood testing show that the modifications have not affected the blood handling properties of the graft.

(2) The report on physical testing is attached in Example 3. The results show that the grafts produced on the needle loom are thinner, stronger in the longitudinal direction and have a lower porosity than the shuttle loom grafts. The shuttle loom grafts have a higher burst strength.

(3) Table 4 in Example 3 compares the tensile strength of the selvedges. The results show that the Muller System II selvedge is slightly weaker than the Muller System III.

Conclusion

The blood testing results show that the needle loom grafts performed as well as the shuttle loom grafts.

Physical testing showed that the needleloom-woven grafts had a lower burst strength than the grafts woven on the shuttle loom. This lower burst strength however, was still far in excess of the limits set for bifurcate grafts. The tensile strength of the Muller System II selvedge was slightly lower than that of the Muller System III selvedge. This difference, although significant, is not high enough to affect the clinical performance of the graft. The needleloom-woven grafts are thinner, stronger in the longitudinal direction and have a lower water porosity than grafts woven on the shuttle loom.

The additional risks proved by this modification have been identified, addressed by testing and shown to be far outweighed by the benefits of the modifications.

EXAMPLE 2

Bench Blood Testing Results

Method

Seven 18 by 9 mm internal diameter needle loom woven bifurcate grafts from the same batch were blood tested according to ISO7198, paragraph 8.2.3 except that anticoagulated animal blood was used as the test fluid. These grafts were all produced on the Muller needle loom with a Muller System II selvedge. The catalogue number for these grafts was 731809 and the batch number 29784. The results of these grafts were then compared with equivalent grafts produced on the Muller shuttle loom and blood tested in August 1997. The grafts tested were:

Cat No.: 732211, batches 25630 and 25682

Cat No.: 732010, batch 24517B

Cat No.: 731407, batches 25034/A and 24505/1A

Results

Needle Loom

Initial Pressurisation—None of the grafts leaked

First Pull—Two of the grafts did not leak. Of the other five, three had small spot leak at the crotch of the bifurcate and the remaining two had a leak on the leg just below the crotch.

Second Pull—One of the grafts did not leak, the remaining six grafts had small leaks at the crotch area of the bifurcate.

Overall Performance—All the grafts performed very well. The leaks, which did occur, were very small and sealed very quickly. The total amount of blood lost from each graft was too small to be measured accurately.

Shuttle Loom

Initial Pressurisation—Four of the grafts did not leak and the other had a few small spot leaks on the legs and body of the graft.

First Pull—Two of the grafts did not leak and the other three had small crotch leaks.

Second Pull—Two of the grafts had crotch leaks only while the other three had between one and three small spot leaks which were mainly on the legs of the graft.

Overall Performance—The grafts performed very well with only small spot leaks occurring on the legs of the graft, which sealed very quickly. The total amount of blood lost from the grafts was negligible.

Conclusion

The grafts manufactured on the Muller needle loom performed as well as those which were manufactured on the Muller shuttle loom. The Muller System II selvedge also performed very well and did not cause any blood loss from the graft.

EXAMPLE 3

Physical Characteristics of Bifurcate Grafts Produced on the Muller Needle and Shuttle Looms Introduction The physical properties of bifurcate grafts manufactured on the Muller needle loom (Muller System II selvedge) were compared with those of bifurcate grafts produced on the Muller shuttle loom (Muller System III selvedge).

Method

Bifurcate grafts were tested according to the following specifications of ISO 7198:

8.2.2—Determination of water porosity on Buxton & Cooley type rig.

8.3.3.2—Measurement of product burst strength—body, seam/black line, crotch.

8.5—Measuring relaxed internal diameter.

8.2.3*—Whole graft porosity test.

* 8% glycerol in propanol was substituted for the test fluid.

8.8—Suture retention.

8.3.2—Longitudinal tensile strength.

8.7.4.2—Wall thickness

The following grafts were tested:

Nine grafts from Batch 29878. These were 18 mm*9 mm bifurcate grafts produced on the Muller Needle loom. The whole graft porosity of nine 18 mm & 9 mm grafts produced on the Muller needle loom (Batch 29784) were also tested. Physical testing of bifurcate grafts produced on the shuttle loom had already been carried out and the results used as a comparison with the needle loom grafts.

Results

TABLE 1

Burst Strength Results

| Area of graft tested | Burst Strength (Newtons) Needle loom | Shuttle Loom |
|---|---|---|
| Body - normal fabric | 403 | |
| Body - black line | 322 | |
| Leg - normal fabric | 388 | |
| Leg - black line | 321 | |
| Overall Mean | 359 | 434 |

The only burst strength data available for the shuttle loom was for the overall mean.

TABLE 2

Water Permeability Results

| Area of graft tested | Water Permeability ($ml/cm^2/minute$) Needle loom | Shuttle Loom |
|---|---|---|
| Body - normal fabric | 223 | |
| Body - black line | 224 | |
| Leg - normal fabric | 248 | |
| Leg - black line | 230 | |
| Overall Mean | 231.3 | 343.3 |

The only water permeability values for grafts produced on the Muller shuttle looms was the overall mean.

TABLE 3

Other Physical Parameters

| Parameter | Needle Loom | Shuttle Loom | Units |
|---|---|---|---|
| Suture retention | 26.81 | 25.86 | Newtons |
| Longitudinal tensile strength | 21.75 | 13.56 | Newtons/mm |
| Wall thickness (nominal) | 0.41 | 0.514 | mm |
| Wall thickness (flat stock) | 0.219 | 0.312 | mm |
| Whole graft porosity | 0.06 | 0.0076* | $ml/cm^2/minute$ |

*whole graft porosity of bifurcates tested 11/96

TABLE 4

Tensile Strength of Selvedges of Grafts Produced on Needle and Shuttle Looms

| Loom type | Tensile strength (Newtons) |
|---|---|
| Needle loom | 181 |
| Shuttle loom | 208 |

Conclusion

Statistical analysis (Student's t-test) of the results show that with the exception of the suture retention, the physical parameters of needle and shuttle loom grafts are different. The needle loom grafts have significantly lower water permeability, higher longitudinal tensile strength and a decreased wall thickness. These characteristics would enhance the performance of the graft.

The needle loom grafts however, have a weaker burst strength and tensile strength at the selvedge. The burst strength although weaker was still well within the set performance limits.

The difference in the tensile strength of the System II and System III selvedges, although significant, was very small. The selvedge strength is an important factor in the burst strength, longitudinal tensile strength and blood handling of the graft. As none of these parameters are being affected negatively, the slightly lower selvedge strength should not affect the clinical performance of the graft.

APPENDIX 1

DRAFT/DENTING

→ WEFT ENTRY

| | | | | | | | |
|---|---|---|---|---|---|---|---|
| 12 | 4 | 16 | 8 | 12 | 4 | 12 | 4 |
| 11 | 3 | 15 | 7 | 11 | 3 | 11 | 3 |
| 2 | 2 | 14 | 6 | 10 | 2 | 10 | 2 |
| 1 | 1 | 13 | 5 | 9 | 1 | 9 | 1 |

← x N →

← 12/dent → ← 16/dent → x 1 x N

What is claimed is:

1. A method of weaving a bifurcated tubular textile article, comprising:

(a) forming first, second, third and fourth superposed layers of warp threads;

(b) weaving by weft insertion through sheds formed in said layers, the weaving being performed by first and second weft threads inserted by first and second needles from one side of said warp layers, each weft thread being inserted alternately through a selected pair of said warp layers, and the weft loops at the other side of said layers being knitted together, the first layer with the second layer and the third layer with the fourth layer, to form a pair of selvedges;

(c) the first weft thread being inserted alternately through the first and second warp layers, and the second weft thread being inserted alternately through the third and fourth warp layers, to form two superposed tubes; and (d) either after or before step (c), using the same warp and weft threads, the first weft thread being inserted alternately through the first and fourth warp layers, and the second weft thread being inserted alternately through the second and third warp layers, to form a single tube folded in a C-shape;

thereby producing a bifurcated article.

2. A method according to claim 1, in which the weft loops are knitted through each other.

3. A method according to claim 1, in which the weft loops are knitted together with a binder thread.

4. A method according to claim 1, in which the tubular article is a surgical or veterinary graft.

5. A method according to claim 4, in which the tubular article is an aortic or iliac graft.

6. A tubular textile article produced by the method of claim 1.

7. A graft produced by the method of claim 1.

8. A needleloom for weaving tubular textile articles, comprising:

warp yarn disposal means for disposing warp yarns in superposed first, second, third and fourth warp yarn layers;

shed-forming means for forming a shed in each of said warp layers;

first and second weft insertion needles for inserting first and second weft threads from one side of said warp layers;

upper and lower selvedge knitting means at the other side of the warp layers for knitting together weft loops formed at the first and second warp layers and the third and fourth warp layers, respectively; and control means operable to cause the needleloom to operate selectively in two modes, one of said modes passing the first weft thread alternately through the first and second warp layers and the second weft thread alternately through the third and fourth warp layers thereby to form two superposed tubes, and the other of said modes passing the first weft thread alternately through the first and fourth warp layers and the second weft thread alternately through the second and third warp layers thereby to form a single tube folded in a C-shape, said two modes being operated sequentially thereby to form a bifurcated article.

9. A needleloom according to claim 8, in which the first and second weft insertion needles are located one above the other with a similar spacing to the spacing between the warp layers, and the control means is operable to cause relative vertical movement between the weft insertion needles and the warp layers.

10. A needleloom according to claim 9, in which the first weft insertion needle is alternately aligned with the first and second warp layers, the second weft insertion needle is alternately aligned with the third and fourth warp layers, and when operating in said second mode the weft threads are interchanged between the first and second weft insertion needles in synchronism with said relative movement.

11. A needleloom according to claim 10, in which the first weft thread passes through a first weft selector and the second weft thread passes through a second weft selector which is located closer to the warp layers than said first weft selector.

* * * * *